US007874813B2

(12) United States Patent
Terauchi

(10) Patent No.: US 7,874,813 B2
(45) Date of Patent: Jan. 25, 2011

(54) VARIABLE DISPLACEMENT COMPRESSOR

(75) Inventor: Kiyoshi Terauchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 0 days.

(21) Appl. No.: 12/160,205

(22) PCT Filed: Dec. 21, 2006

(86) PCT No.: PCT/JP2006/325492

§ 371 (c)(1),
(2), (4) Date: Jul. 7, 2008

(87) PCT Pub. No.: WO2007/077750

PCT Pub. Date: Jul. 12, 2007

(65) Prior Publication Data

US 2009/0004025 A1 Jan. 1, 2009

(30) Foreign Application Priority Data

Jan. 6, 2006 (JP) ..... 2006-001189

(51) Int. Cl.
*F04B 1/26* (2006.01)

(52) U.S. Cl. ..... 417/222.2

(58) Field of Classification Search ..... 417/395, 417/279, 222.2

See application file for complete search history.

(56) References Cited

U.S. PATENT DOCUMENTS 5,620,310 A * 4/1997 Takenaka et al. ..... 417/222.2
5,890,876 A * 4/1999 Suito et al. ..... 417/213
6,260,369 B1 * 7/2001 Yokomachi et al. ..... 62/228.5
6,662,582 B2 * 12/2003 Hirota et al. ..... 62/228.3
7,104,075 B2 * 9/2006 Meeker ..... 62/77
7,210,911 B2 5/2007 Ota et al.

FOREIGN PATENT DOCUMENTS

JP H04-350372 A 12/1992
JP H07-119642 A 5/1995
JP H11-037325 A 2/1999
JP 2002-061571 A 2/2002
JP 2005-127278 A 5/2005
JP 2005-146860 A 6/2005

OTHER PUBLICATIONS

International Search Report (PCT/JP2006/325492), mailed Feb. 27, 2007.

* cited by examiner

*Primary Examiner*—Devon C Kramer
*Assistant Examiner*—Bryan Lettman
(74) *Attorney, Agent, or Firm*—Baker Botts L.L.P.

(57) ABSTRACT

A variable displacement compressor comprising a first control means for detecting the suction pressure of fluid or the crank chamber pressure and controlling the suction pressure to a target control value, and a second control means including means for detecting high-pressure side pressure to control the displacement of the compressor so as to relax an increase in the high-pressure side pressure when it is equal to or higher than a predetermined threshold and increasing the control value of the suction pressure depending on the increase in the high-pressure side pressure in a region exceeding the threshold. The control system is simple, the control valve is inexpensive and simple and capable of stabilized operation, and the variable displacement compressor has the internal control means suitable for refrigeration cycle operating in a supercritical region.

20 Claims, 2 Drawing Sheets

VARIABLE DISPLACEMENT COMPRESSOR

TECHNICAL FIELD OF THE INVENTION

The present invention relates to a variable displacement compressor used in a refrigeration circuit for air conditioning for vehicles, etc., and specifically, to a variable displacement compressor having a control means therein for controlling the displacement.

BACKGROUND ART OF THE INVENTION

Recently, in the use for air conditioning for vehicles, etc., in order to decrease influence to global warmth, a refrigeration cycle using a natural-system refrigerant such as carbon dioxide has been developed. However, with respect to carbon dioxide, in the use employed in a relatively high-temperature region such as an air conditioning system for vehicles, because the operational temperature in the refrigeration cycle exceeds the critical point of the refrigerant, it operates in a supercritical region in which the high-temperature-side refrigerant gas cannot be condensed. Since the temperature and the pressure of the gas in the supercritical region do not correspond to each other by a relationship of one to one, if there is a great fluctuation in the rotational speed or a great fluctuation in the load of the compressor driven by an engine in a vehicle and the like, the increase of the high-pressure side pressure is great, and an inconvenience, that the pressure exceeds an acceptable high pressure limit, is liable to occur. Therefore, a stable operation at a high pressure, such as an operation in a system where the temperature and the pressure of the refrigerant meet with each other by a relationship of one to one because of being condensed even at a high pressure as in a case using R134a and the like as the refrigerant, cannot be expected.

In order to solve this problem, Patent document 1 discloses the means wherein, in a variable displacement compressor controlling the displacement by a crank chamber pressure, a relief valve provided between a discharge chamber and a crank chamber is opened at the time of an abnormal high pressure, the crank chamber pressure is increased by flowing gas thereinto from the high-pressure side, and the displacement is decreased by decreasing the piston stroke of the compressor.

Further, Patent document 2 discloses the means wherein a suction pressure control means for controlling the displacement for discharge of the variable displacement compressor so that a predetermined suction pressure is achieved by a suction pressure detecting means and a discharge pressure control means for controlling the displacement for discharge so that a predetermined discharge pressure is achieved by a pressure detecting means for a discharge-pressure region are provided, and an abnormal increase of discharge pressure is suppressed by switching the control between the suction pressure control means and the discharge pressure control means depending on the detected pressure sent from the discharge pressure detecting means.

However, in the method for using a relief valve as described in Patent document 1, because the displacement of the compressor rapidly decreases when the discharge pressure exceeds a predetermined threshold value, the cooling operation of the refrigeration cycle is interrupted, and such a condition is not preferable from the viewpoints of comfortableness and cooling performance as a cooling device. Further, there is also a problem that the system and the device become complicated because a relief valve becomes necessary other than a control valve.

On the other hand, in the variable displacement compressor described in Patent document 2, because the suction pressure control and the discharge pressure control are employed by being switched, the control is improved from the viewpoints of comfortableness and cooling performance as a cooling device. However, there is a problem that the calculation routine of the control for switching the operations of the control valves, the detecting means and the control system become complicated. Further, an electronic control valve capable of externally controlling electronically is required as the control valve, and the structure and the cost as the whole of the system become complicated and expensive.

Patent document 1: JP-A-2002-61571

Patent document 2: JP-A-2005-127278

DISCLOSURE OF THE INVENTION

Problems to be Solved by the Invention

Accordingly, an object of the present invention is to solve the problems present in the high-pressure control means in the above-described conventional compressors, and is to provide a variable displacement compressor in which the control system is simple, and the control valve is inexpensive and simple and capable of stabilized operation, and which has an internal control means suitable for a refrigeration cycle operating in a supercritical region.

Means for Solving the Problems

To achieve the above-described object, a variable displacement compressor according to the present invention comprises a first control means for detecting a suction pressure of fluid or a crank chamber pressure and controlling the suction pressure to a target control value, and a second control means including means for detecting high-pressure side pressure to control the displacement of the compressor so as to relax an increase in the high-pressure side pressure when it is equal to or higher than a predetermined threshold and increasing the control value of the suction pressure depending on an increase in the high-pressure side pressure in a region exceeding the threshold.

In the variable displacement compressor, as the fluid being compressed, a fluid capable of operating in a supercritical region, particularly, carbon dioxide can be used.

Further, the variable displacement compressor can employ a structure wherein the first control means or/and the second control means has a valve portion, and the opening/closing operation of the valve portion is controlled by the suction pressure or/and the high-pressure side pressure.

Further, the compressor also can employ a structure wherein each of the above-described first control means and second control means is formed as a single control valve capable of being incorporated into the compressor, for achieving facilitation of manufacturing and assembling, decrease of the number of parts and cost down.

Effect According to the Invention

In the variable displacement compressor according to the present invention, by the internal control technology due to the first control means and second control means, a displacement control high in comfortableness, cooling performance and stability can be performed by a simple and inexpensive structure even for a supercritical refrigeration cycle, and can be provided a displacement control technology of a variable displacement compressor suitable for a supercritical cycle.

EXPLANATION OF SYMBOLS

Figure 1:
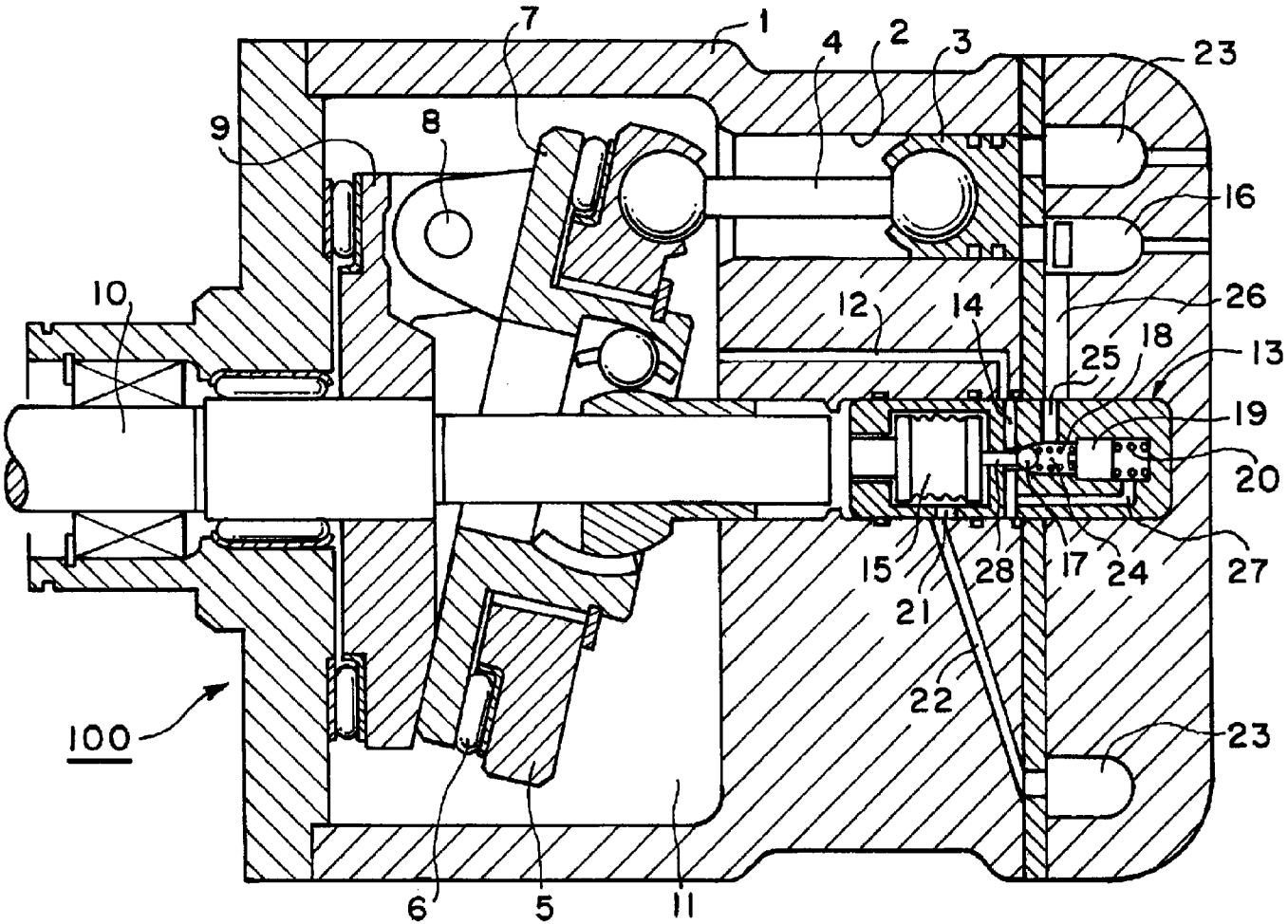
FIG. 1 is a schematic vertical sectional view of a variable displacement compressor according to an embodiment of the present invention.

1: cylinder block
2: cylinder
3: piston
4: connecting rod
5: swash plate
6: thrust bearing
7: inclined plate cam
8: link mechanism
9: rotor
10: drive shaft
11: crank chamber
12: gas passageway
13: control valve
14: hole
15: pressure sensitive member
16: discharge chamber
17: valve portion
18: spring
19: piston-like pressure sensitive member
20: spring
21: hole
22: communication path
23: suction chamber
24: chamber
25: hole
26: communication path
27: communication path
28: rod portion
100: variable displacement compressor

THE BEST MODE FOR CARRYING OUT THE INVENTION

Hereinafter, desirable embodiments of the present invention will be explained referring to figures.

FIG. 1 shows a variable displacement compressor 100 according to an embodiment of the present invention. In FIG. 1, a plurality of pistons 3 are inserted into a plurality of cylinders 2 formed in a cylinder block 1, respectively, and each piston 3 is connected to a swash plate 5 via a connecting rod 4. Swash plate 5 is connected to an inclined plate cam 7 via a thrust bearing 6 so that a force is transmitted between swash plate 5 and inclined plate cam 7. Inclined plate cam 7 is linked to a rotor 9 via a link mechanism 8 at a condition capable of varying the inclined angle so that a rotational force is transmitted therebetween. Rotor 9 is fixed to a drive shaft 10.

In a crank chamber 11, the gas force balance is changed by adjusting the crank chamber pressure, thereby changing the inclined angle of inclined plate cam 7. In order to obtain the source of this crank chamber pressure, crank chamber 11 communicates with an entrance hole 14 of a control valve 13 through a gas passageway 12.

Figure 2:
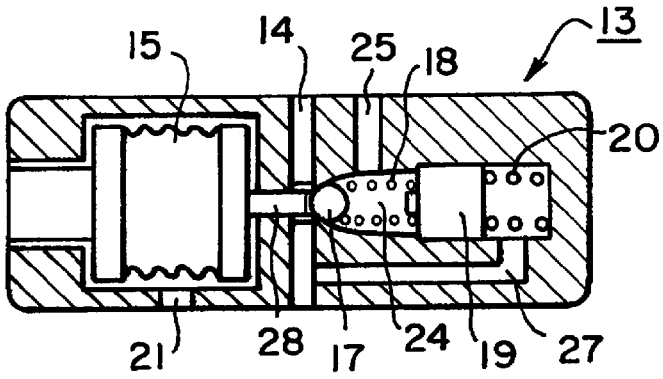
FIG. 2 is an enlarged sectional view of a control valve in the variable displacement compressor depicted in FIG. 1.

As shown also in FIG. 2, control valve 13 comprises a first control means and a second control means according to the present invention, and in this embodiment, it is structured as a control valve formed as a single member incorporated into variable displacement compressor 100. This control valve 13 has a pressure sensitive member 15 for detecting a suction pressure, a valve portion 17 for opening/closing the communication between a discharge chamber 16 and crank chamber 11, a spring 18, a piston-like discharge pressure sensitive member 19 and a spring 20. A hole 21 of control valve 13 is communicated with the side of a suction chamber 23 through a communication path 22. A hole 25 is communicated with a chamber 24 containing valve portion 17 and spring 18, and hole 25 communicates with discharge chamber 16 side through a communication path 26.

Pressure sensitive member 15 is structured from a bellows or a diaphragm, and in the example depicted in the figure, a bellows is used. Pressure sensitive member 15 detects a suction pressure, and operates so as to open valve portion 17 if the detected pressure is lower than a predetermined value and so as to close valve portion 17 if the detected pressure is higher than that. By adjusting the gas introduction amount of discharge side gas into crank chamber 11 by this operation, the pressure in crank chamber 11 is adjusted, and the inclination angle of inclined plate cam 7 is adjusted. By this, the displacement of the compressor is controlled by feedback so that the suction pressure becomes a target control value.

Valve portion 17 is connected to discharge pressure sensitive member 19 via spring 18, and discharge pressure sensitive member 19 changes a force urging valve portion 17 through spring 18 by movement caused by receiving the discharge pressure. One side of discharge pressure sensitive member 19 communicates with the low-pressure side of crank chamber 11 or suction chamber 23 whose pressure is introduced through a communication path 27, and a force, which is obtained by the product of a pressure difference between the discharge pressure and the crank chamber pressure (or the suction pressure) and the pressure-receiving area of discharge pressure sensitive member 19, consequently operates in a direction for opening valve portion 17. Because this force increases and the force for opening valve portion 17 increases when the discharge pressure is high, the pressure in crank chamber 11 is increased, the inclination angle of inclined plate cam 7 is decreased to decrease the stroke of piston 3, and increase of the discharge pressure is suppressed.

Since this force due to the discharge pressure substantially does not work unless this force exceeds a force Xk determined as the product of a compressed amount X and a spring factor "k" of spring 20, after all, from the relationship between pressure difference $\Delta Pdc$ between discharge pressure Pd and crank chamber pressure Pc and an effective area Sd of discharge pressure sensitive member 19, $\Delta Pdc \cdot Sd = Xk$ stands, and a force starting to move begins to work at Pd1 corresponding to $\Delta Pdc$ satisfying $Pdc = Xk/Sd$. This relationship is shown in FIG. 3.

Figure 3:
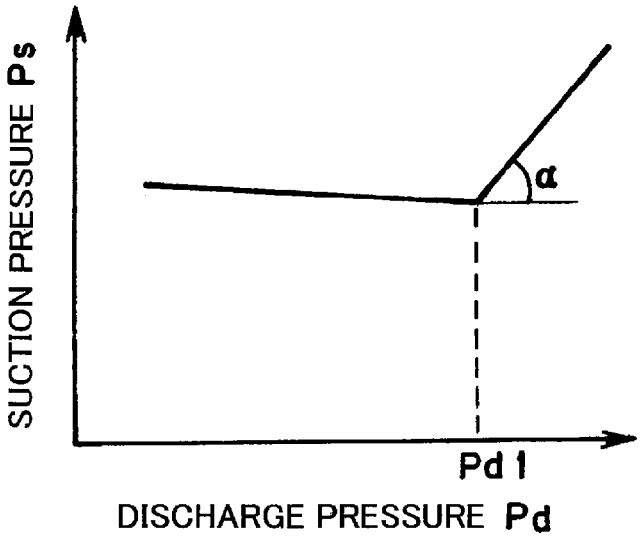
FIG. 3 is a diagram indicating a relationship between a discharge pressure and a suction pressure for showing a control property in the present invention.

In FIG. 3, in a region where discharge pressure Pd is smaller than a predetermined threshold Pd1, suction pressure Ps is controlled so as to be constant or so as to be slightly decreased relative to increase of the discharge pressure, and in a region where discharge pressure Pd exceeds Pd1, suction pressure Ps increases as discharge pressure Pd increases. By this, in a high-discharge pressure region exceeding Pd1, the capacity of the compressor is gradually decreased and a rapid increase of discharge pressure can be prevented.

The gradient a indicating the increase of suction pressure in FIG. 3 can be obtained as a target property by appropriately designing the pressure receiving area of discharge pressure sensitive member 19. Further, also as to threshold Pd1, similarly, it can be arbitrarily designed by setting of the force of spring 20.

The crank chamber pressure flows out from crank chamber 11 to suction chamber 23 by the leak through the gap at rod portion 28 of pressure sensitive member 15 of control valve 13.

Where, although the compression mechanism has been explained as a variable displacement mechanism using the swash plate in FIG. 1, it may be structured as a single inclined plate type compression mechanism.

(1) Further, in the explanation of the operation in the above-described embodiment, although the means for adjusting the amount of gas introduced from the discharge chamber to the crank case is exemplified as the means for adjusting the crank chamber pressure for adjusting the displacement, a similar operation is possible even by means for adjusting the amount of gas flowing out from the crank chamber to the suction chamber.

Figure 4:
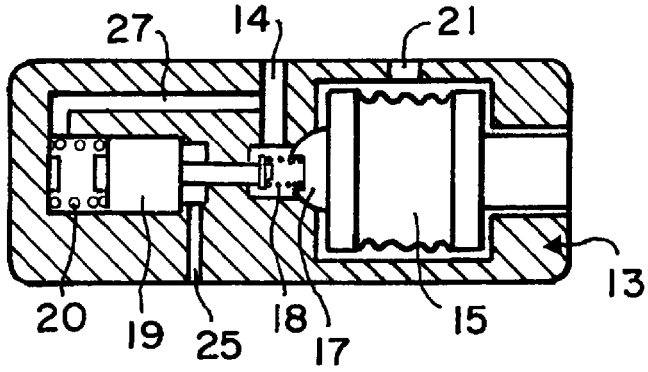
FIG. 4 is a sectional view showing another example of a control valve in the variable displacement compressor according to the present invention.

(2) Further, although the above description has been explained with respect to the example in which the suction pressure is detected by pressure sensitive member 15, it may be means for detecting the pressure in crank chamber 11. A structural example of control valve 13 in this case is depicted in FIG. 4. In FIG. 4, the same symbols as those in FIG. 2 are given to portions having the same functions as those in the control valve depicted in FIG. 2. In FIG. 4, hole 21*a* case where communicates with suction chamber 23 and hole 14 communicates with crank chamber 11 corresponds to the example of the above-described case (1), and an opposite case corresponds to the example of the above-described case (2).

As described above, since the crank chamber pressure is adjusted for adjusting the displacement in sensitive response simultaneously to the discharge pressure and the suction pressure, even in a refrigeration cycle using refrigerant such as carbon dioxide which is difficult to be stabilized at the high-pressure side, a proper control for the suction pressure and the discharge pressure can be carried out simply.

INDUSTRIAL APPLICATIONS OF THE INVENTION

The variable displacement compressor according to the present invention is suitable for use in a refrigeration cycle operating in a supercritical region, and particularly, suitable for a refrigeration cycle using carbon dioxide as refrigerant.

The invention claimed is:

1. A variable displacement compressor comprising:

a first control means for detecting a suction pressure of fluid or a crank chamber pressure and controlling said suction pressure to a target control value;

a second control means for detecting a high-pressure side pressure and for controlling a displacement of the compressor, wherein said high-pressure side pressure is reduced when the high-pressure side pressure is equal to or higher than a predetermined threshold and said target control value of said suction pressure is increased when said high-pressure side pressure-exceeds said threshold, wherein said target control value is held constant or is decreased relative to an increase of the high-pressure side pressure, when the high-pressure side pressure is less than said threshold, and wherein the predetermined threshold is constant.

2. The variable displacement compressor according to claim 1, wherein said fluid is a fluid capable of operating in a supercritical region.

3. The variable displacement compressor according to claim 2, wherein said fluid capable of operating in a supercritical region is carbon dioxide.

4. The variable displacement compressor according to claim 1, wherein said first control means or/and said second control means has a valve portion, and the opening/closing operation of said valve portion is controlled by said suction pressure or/and said high-pressure side pressure.

5. The variable displacement compressor according to claim 1, wherein each of said first control means and said second control means is formed as a single control valve capable of being incorporated into the compressor.

6. A variable displacement compressor comprising:

a first pressure sensitive member configured to adjust an amount of a fluid discharged into a crank chamber, such that a suction pressure approaches a target value;

a second pressure sensitive member configured to adjust the amount of fluid discharged into the crank chamber, such that the target value increases when a discharge pressure exceeds a threshold value, wherein the target value is held constant or is decreased relative to an increase of the discharge pressure, when the discharge pressure is less than the threshold value, and wherein the threshold value is constant.

7. The variable displacement compressor of claim 6, further comprising:

a valve configured to communicate said fluid between a discharge chamber and the crank chamber.

8. The variable displacement compressor of claim 7, wherein the first pressure sensitive member adjusts the amount of fluid discharged into the crank chamber by controlling the valve.

9. The variable displacement compressor of claim 8, wherein the second pressure sensitive member adjusts the amount of fluid discharged into the crank chamber by controlling the valve.

10. The variable displacement compressor of claim 6, wherein the first pressure sensitive member comprises a bellows or a diaphragm.

11. The variable displacement compressor of claim 6, wherein the second pressure sensitive member comprises a piston and a spring.

12. The variable displacement compressor of claim 6, wherein the fluid passes through a supercritical region during operation of the compressor.

13. The variable displacement compressor of claim 6, wherein the fluid is carbon dioxide.

14. An internal control valve for controlling a pressure difference in a variable displacement compressor, comprising:

a valve portion configured to adjust an opening between a discharge pressure side of the internal control valve and a suction pressure side of the internal control valve;

a first pressure sensitive member configured to open the valve portion when a suction pressure of the suction pressure side is below a target value and to close the valve portion when the suction pressure is above the target value;

a second pressure sensitive member configured to further open the valve portion when a discharge pressure of the discharge side exceeds a threshold value, wherein the target value is held constant or is decreased relative to an increase of the discharge pressure, when the discharge pressure is less than the threshold value, and wherein the threshold value is constant.

15. The internal control valve of claim 14, wherein the first pressure sensitive member comprises a bellows or a diaphragm.

16. The internal control valve of claim 14, wherein the second pressure sensitive member comprises a piston and a spring.

17. The internal control valve of claim 16, wherein the threshold value is determined by a spring factor of the spring.

18. The variable displacement compressor according to claim 1, wherein the target control value is decreased relative to an increase of the high-pressure side pressure, when the high-pressure side pressure is less than said threshold.

19. The variable displacement compressor of claim 6, wherein the target value is decreased relative to an increase of the discharge pressure, when the discharge pressure is less than the threshold value.

20. The internal control valve of claim 14, wherein the target value is decreased relative to an increase of the discharge pressure, when the discharge pressure is less than the threshold value.

* * * * *